US006663205B2

(12) United States Patent
Uetsuki

(10) Patent No.: US 6,663,205 B2
(45) Date of Patent: Dec. 16, 2003

(54) INK JET PRINTING APPARATUS, INK INFORMATION DETECTING DEVICE, AND INK INFORMATION DETECTING METHOD

(75) Inventor: Masaya Uetsuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,303

(22) Filed: Feb. 7, 2002

(65) Prior Publication Data

US 2002/0118236 A1 Aug. 29, 2002

(30) Foreign Application Priority Data

Feb. 9, 2001 (JP) ..... 2001/034554

(51) Int. Cl.[7] ..... B41J 2/175
(52) U.S. Cl. ..... 347/7
(58) Field of Search ..... 347/7, 19; 399/24, 399/27

(56) References Cited

U.S. PATENT DOCUMENTS 4,626,874 A * 12/1986 Murai et al. ..... 347/7
5,929,885 A 7/1999 Nakajima et al.
6,024,429 A * 2/2000 Coffy et al. ..... 347/7
6,151,039 A 11/2000 Hmelar et al.
6,286,921 B1 9/2001 Ochi et al.

FOREIGN PATENT DOCUMENTS

| | | |
|---|---|---|
| JP | 5-42680 | 2/1993 |
| JP | 5-309922 | 11/1993 |
| JP | 6-226989 | 8/1994 |
| JP | 6-270410 | 9/1994 |
| JP | 6-286160 | 10/1994 |
| JP | 6-320751 | 11/1994 |
| JP | 9-169118 | 6/1997 |
| JP | 11-334107 | 12/1999 |

* cited by examiner

*Primary Examiner*—Craig Hallacher
(74) *Attorney, Agent, or Firm*—Fitzpatrick, Cella, Harper & Scinto

(57) ABSTRACT

The present invention provides an ink jet printing apparatus, ink information detecting apparatus, and ink information detection method which can calculate ink consumption without any errors by combining two detection devices. In an ink jet printing apparatus that prints an image on a print medium by using a print head that can eject ink fed from an ink tank, ink consumption is detected on the basis of the number of ink droplets ejected from the print head, and the amount of ink remaining in the ink tank is detected by pins used as a pair of electrodes. Further, a value used to calculate the ink consumption is corrected on the basis of the results of detection of the amount of remaining ink.

28 Claims, 13 Drawing Sheets

INK JET PRINTING APPARATUS, INK INFORMATION DETECTING DEVICE, AND INK INFORMATION DETECTING METHOD

This application is based on Patent Application No. 2001-034554 filed Feb. 9, 2001 in Japan, the content of which is incorporated hereinto by reference.

BACKGROUND OF THE INVENTION

1. Field of the Invention

The present invention relates to an ink jet printing apparatus, an ink information detecting apparatus, and an ink information detecting method.

2. Description of the Related Art

In recent years, a market has been expanded for ink jet (IJ) printing apparatuses for use in offices, homes, and the like. However, these printing apparatuses can no longer perform printing operations once ink as a printing material is used up. On the other hand, with a laser beam-based printing apparatus (LBP), a printed image starts to appear lighter when toner as a printing material is almost used up, thereby allowing a user to determine when to refill the apparatus with toner. Thus, it is more important for ink jet printing apparatuses to accurately detect the amount of remaining ink as a printing material than for LBPs or general-purpose copiers.

As a method of detecting the amount of ink remaining in an ink jet printing apparatus, a method has been proposed which uses an ink tank the interior of which can be seen from the outside thereof so that a user can check the amount of ink remaining in the ink tank. A specific example includes a construction in which a part of the ink tank is made transparent as described in Japanese Patent Application Laying-open No. 5-42680 (1993) or a construction in which ink is accommodated directly in a part of an ink chamber so that the amount of remaining ink can be checked from the outside as described in Japanese Patent Application Laying-open No. 6-286160 (1994). Further, Japanese Patent Application Laying-open No. 6-226989 (1994) describes a method of optically determining the amount of ink that decreases step by step by dividing the ink chamber into a number of parts. Furthermore, Japanese Patent Application Laying-open No. 5-309922 (1993) describes a method of detecting the amount of remaining ink each time a predetermined printing operation is performed. That is, this publication describes a method of using a serial scan method to cause a print head to print an image corresponding to one line on a print sheet, using a presence detecting sensor to detect a partial image of the printed image, and determining the amount of remaining ink on the basis of the result of the detection. Moreover, Japanese Patent Application Laying-open No. 6-270410 (1994) describes a method of detecting ink using electrodes.

Methods have also been proposed in which the main body of the printing apparatus detects the amount of ink remaining in the ink tank in order to determine the amount of remaining ink to give a warning or to limit the printing operation. For instance, Japanese Patent Application Laying-open No. 6-320751 (1994) describes a method of counting the number of ink dots formed on a printed medium and detecting the amount of remaining ink on the basis of the counts. Further, Japanese Patent Application Laying-open No. 11-334107 (1999) describes a method of detecting the amount of remaining ink by taking into consideration the size of ink dots. These methods count the number of ink dots, and calculates the amount of remaining ink on the basis of this dot count information. In contrast with a method of directly detecting ink in a container such as a tank that accommodates the ink, these dot count methods of calculating the amount of remaining ink on the basis of the dot count information are also called "remaining amount estimating methods" because the mathematically estimate the amount of remaining ink.

In the method of detecting the amount of remaining ink on the basis of such a dot count method, because of a variation in the amount of ink ejected per dot from the print head, it is unavoidable that a certain error occurs in detection of the amount of remaining ink. To solve this problem, Japanese Patent Application Laying-open No. 9-169118 (1997) and U.S. Pat. No. 6,151,039 describe methods comprising detecting means of a mechanical construction which is operated using a switch when the amount of remaining ink reaches a predetermined value, to correct a dot count value when the detecting means performs a detecting operation.

As described above, the various methods have been proposed as methods of detecting the amount of remaining ink. In connection with the aspect of manufacture of print heads, it is unavoidable that the amount of ejected ink varies, and this variation leads to an error in detection of the amount of remaining ink on the basis of the dot count method. As a result, even if the number of dots is counted accurately, an error is involved in the ink consumption calculated using the count. Further, if the count of the dot number is corrected when the detecting means of a mechanical construction performs a detecting operation, as proposed by Japanese Patent Application Laying-open No. 9-169118 (1997), then the count is not corrected until the detecting means of a mechanical construction performs a detecting operation, and thus still contains an error. Furthermore, none of the above described publications describe the use of a corrected value such as the count of the dot number for purposes other than the detection of the amount of remaining ink.

SUMMARY OF THE INVENTION

It is an object of the present invention to provide an ink jet printing apparatus, an ink information detecting apparatus, and an ink information detecting method which can calculate the ink consumption without any errors by combining two detecting means.

The present invention provides an ink jet printing apparatus that prints an image on a print medium by using a print head that can eject ink fed from an ink tank, the ink jet printing apparatus comprising estimating means for mathematically estimating ink consumption on the basis of driving conditions for the print head, detecting means for detecting that the amount of ink remaining in the ink tank has decreased to a predetermined value, and correcting means for correcting a value used by the estimating means to calculate the ink consumption, on the basis of results of detection by the detecting means.

The present invention provides an ink information detecting apparatus that detects information on ink fed from an ink tank to a print head that can eject ink, the ink information detecting apparatus comprising estimating means for mathematically estimating ink consumption on the basis of driving conditions for the print head, detecting means for detecting that the amount of ink remaining in the ink tank has decreased to a predetermined value, and correcting means for correcting a value used by the estimating means to calculate the ink consumption, on the basis of results of detection by the detecting means.

The present invention provides an ink information detecting method of detecting information on ink fed from an ink tank to a print head that can eject ink, the method comprising the steps of mathematically estimating ink consumption on the basis of driving conditions for the print head, and correcting a value used to calculate the ink consumption, on the basis of results of detection of the amount of ink remaining in the ink tank.

The present invention provides an ink jet printing apparatus that prints an image on a print medium by using a print head that can eject ink fed from an ink tank, the apparatus comprising count means for counting the number of operations that consume ink, the operations including printing operations, detecting means for detecting that the amount of ink remaining in the ink tank has decreased to a predetermined value, remaining amount calculating means for calculating the amount of ink remaining in the ink tank on the basis of the value counted by the count means as well as a unit consumption corresponding to the operations after the detecting means has detected that the amount of ink remaining in the ink tank has decreased to the predetermined value, and correcting means for correcting the unit consumption on the basis of the count indicated by the count means when the detecting means has detected that the amount of ink remaining in the ink tank has decreased to the predetermined value, and wherein the calculating means calculates the amount of remaining ink on the basis of the unit consumption corrected by the correcting means.

The present invention provides a method of calculating the amount of ink in ink tank in an ink jet printing apparatus that prints an image on a print medium by using a print head that can eject ink fed from an ink tank, the method comprising the steps of counting the number of operations that consume ink, the operations including printing operations, detecting that the amount of ink remaining in the ink tank has decreased to a predetermined value, correcting a unit consumption used to calculate the amount of remaining ink, on the basis of the count obtained at the counting step when the detecting step has detected that the amount of ink remaining in the ink tank has decreased to the predetermined value, and after the detecting step has detected that the amount of ink remaining in the ink tank has decreased to the predetermined value, counting the number of operations that consume ink, the operations including printing operations, and calculating the amount of ink remaining in the ink tank on the basis of the unit consumption corrected by the correcting step.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described with reference to the drawings.

Figure 1:
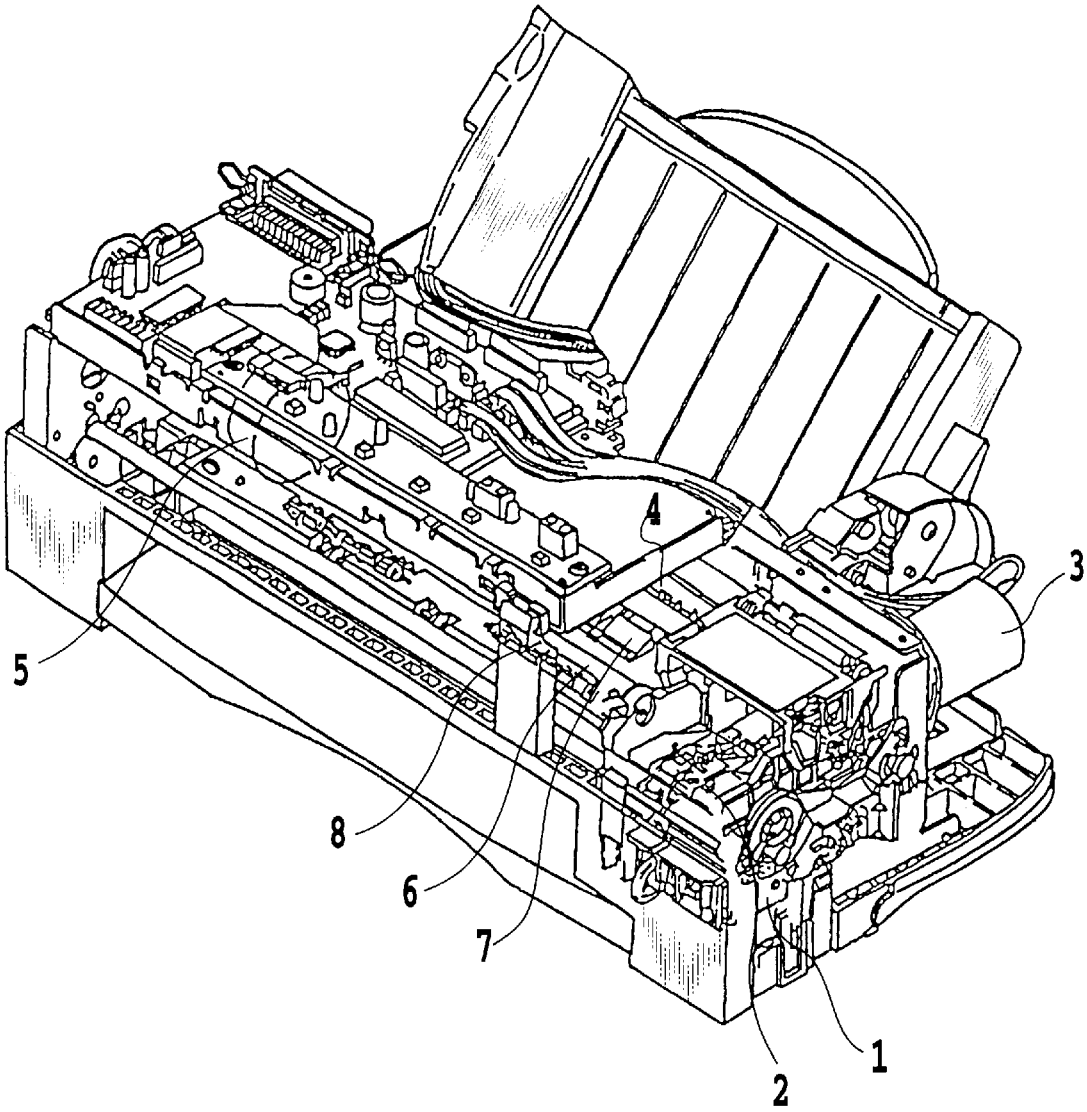
FIG. 1 is a perspective view of a printing apparatus according to an embodiment of the present invention.

FIG. 1 is an outside drawing of essential parts of a printer to which the present invention is applicable. This printer is what is called a serial scan type printing apparatus that prints an image by causing a print head to perform a scanning operation in a direction (main scanning direction) orthogonal to a direction (sub-scanning direction) in which printed media are transported. In a printing operation, first, a sheet feeding roller 6 driven by a sheet feeding motor 5 via gears transports a printed medium to a predetermined position. Then, a carriage motor 3 is used to move a carriage 2 in the main scanning direction, while ink is ejected from the print head mounted on the carriage 2, to print an image of a specified band width on the printed medium. Subsequently, the printed medium is transported a predetermined distance (this operation will hereinafter be referred to as "sheet feeding") in the sub-scanning direction. By repeating this operation, images are sequentially printed on the printed media. With the serial scan method, a sheet may be fed after the print head has performed a plurality of scanning operations for printing rather than being fed each time the print head performs a single printing operation for printing. Further, an image of one band may be completed by causing the print head to perform a plurality of scanning operations and feeding a sheet a plurality of times. That is, each time the print head performs a scanning operation, a predetermined mask is used to thin print data for printing, while feeding a print sheet a distance corresponding to one-n-th of a band width.

Furthermore, in the present embodiment, a carriage belt 4 is used as a means for transmitting drive force from the carriage motor 3 to the carriage 2. However, in place of the carriage belt 4, other transmission means such as lead screws may be used. Moreover, the fed print medium passes between the sheet feeding roller 6 and a pressure roller 7, and is guided to a print position at which the print head performs a printing operation. While at rest, the print head is capped by a cap of a purge unit 1, and when a printing operation is to be performed, the cap is first opened to enable the carriage 2 to move in the main scanning direction. Subsequently, once print data for one scanning operation has been accumulated in a buffer, the carriage motor 3 moves the carriage 2 in the main scanning direction, while ink is ejected from the print head to print an image.

Figure 2:
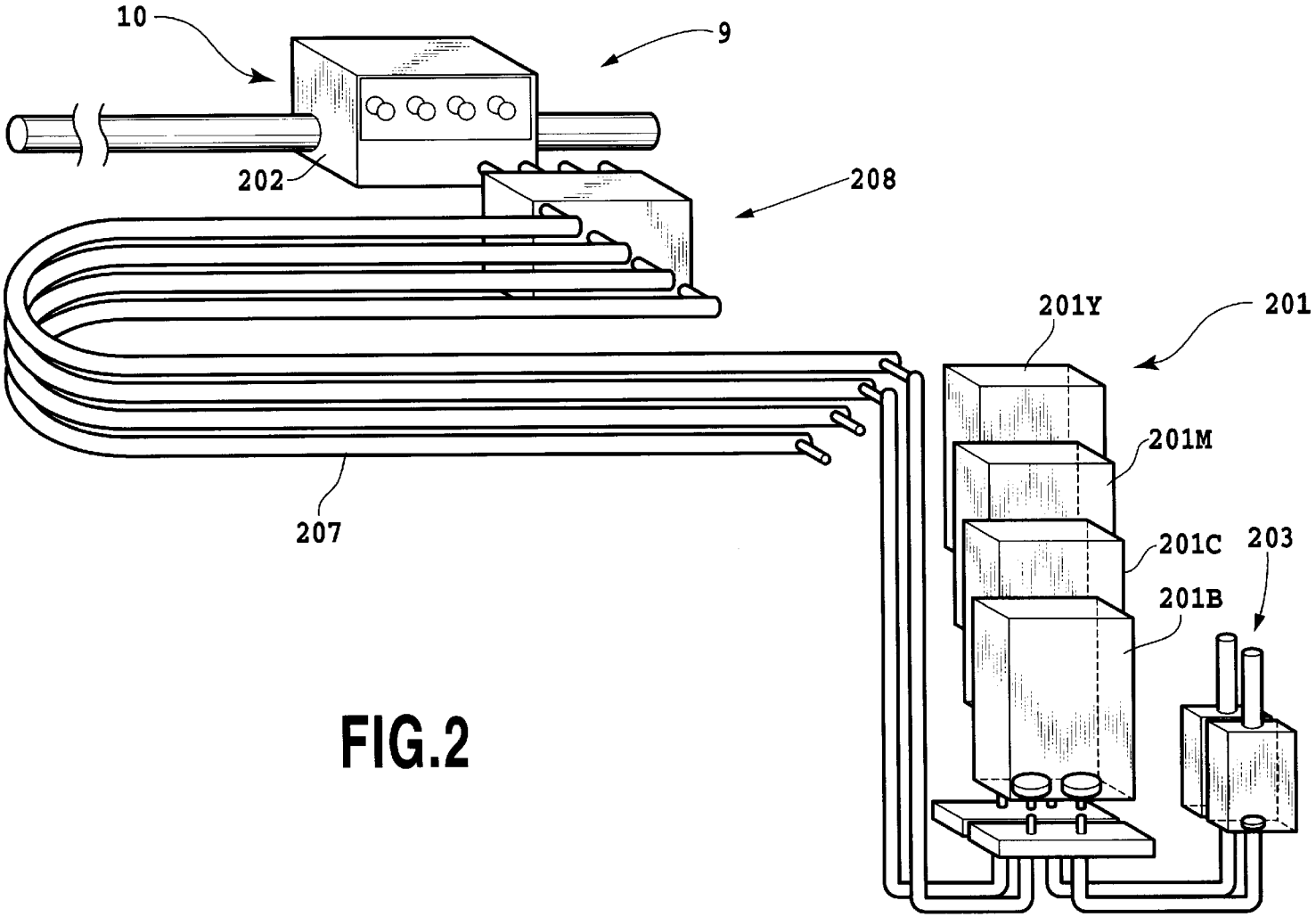
FIG. 2 is a view showing the construction of an ink supply system in the printing apparatus in FIG. 1.

FIG. 2 is an explanatory drawing of an ink supplying system in the printing apparatus of the present embodiment. Ink is fed from a main ink tank 201 to a sub ink tank 202 on the carriage 2 via a tube 207 and a joint 208, and then fed to the print head 9. In the ink tank 201, reference numerals 201Y, 201M, 201C, and 201B denote ink accommodating sections for yellow, magenta, cyan, and black ink, respectively. The print head 9 moves in the main scanning direction along a shaft 10 together with the carriage 2. Reference numeral 203 denotes a buffer chamber.

The main tank 201 installed at a specified position of the apparatus main body may supply ink directly to the print head 9. However, in order to reduce loads on the carriage 2, increase printing speed, and reduce the size and weight of the apparatus, it is effective to miniaturize the sub tank 202 mounted on the carriage 2 as shown in this example. That is, the subtank 202 of a relatively small capacity may be mounted on the carriage 2 to feed ink from the subtank 202 to the print head 9, and the main tank of a relatively large capacity, which is installed at the specified position of the apparatus main body, may supply ink to the subtank 202. A supply joint 208 forms an ink supply route between the main tank and the subtank after the carriage 2 has moved to a predetermined position such as a home position. Therefore, ink can be fed from the main tank 201 to the subtank 202 during the optimum period depending on the capacity of the subtank 202 and the ink consumption of the print head 9.

The printed medium is not particularly limited as long as it is suitable for printing based on the ink jet method. The printed medium may be, for instance, what is called ordinary paper, coated paper comprising paper and an ink absorption layer formed thereon and composed of calcium carbonate, TiO2, or a binding agent, or a film comprising a polymer film and an absorption layer formed thereon and composed of an $Al_2O_3$ porous substance or the like which absorbs ink.

Further, any of the water-soluble organic solvents used for well-known ink can be used for the ink. Specifically, these water-soluble organic solvents include alkyl alcohols with 1 to 5 carbons such as methyl alcohol, ethyl alcohol, n-propyl alcohol, isopropyl alcohol, n-butyl alcohol, sec-butyl alcohol, tert-butyl alcohol, isobutyl alcohol, and n-pentanol; amides such as dimethyl formamide and dimethyl acetoamide; ketones or keto alcohols such as acetone and diacetone alcohol; ethers such as tetra hydrofuran and dioxane; oxyethylene- or oxypropylene- added polymers such as diethylene glycol, triethylene glycol, tetra ethylene glycol, dipropylene glycol, tripropylene glycol, polyethylene glycol, and polypropylene glycol; alkylene glycols having an alkylene group with 2 to 6 carbon atoms, such as ethylene glycol, propylene glycol, trimethylene glycol, butylene glycol, 1,2,6-hexane triol, and hexylene glycol; thio diglycol; glycerine; lower alkyl ethers of polyhydric alcohols such as ethylene glycol monomethyl (or ethyl) ether, diethylene glycol monomethyl (or ethyl) ether, and triethylene glycol monomethyl (or ethyl) ether; lower dialkyl ethers of polyhydric alcohols such as triethylene glycol dimethyl (or ethyl) ether and tetra ethylene glycol dimethyl (or ethyl), and sulfolane, N-methyl-2-pyrrolidone, and 1,3-dimethyl-2-imidazolidinone. Generally speaking, the content of such a water soluble organic solvent is 1 to 49 wt % of the total weight of the ink, and more preferably, 2 to 30 wt %. Moreover, the above-mentioned water-soluble organic solvents may be individually used or may be mixed together, but if the water-soluble organic solvent is used with any medium, this liquid medium is most preferably composed of at least one water-soluble organic solvent with high boiling point, for instance, one containing polyhydric alcohol such as diethylene glycol, triethylene glycol, or glycerine.

Figure 3:
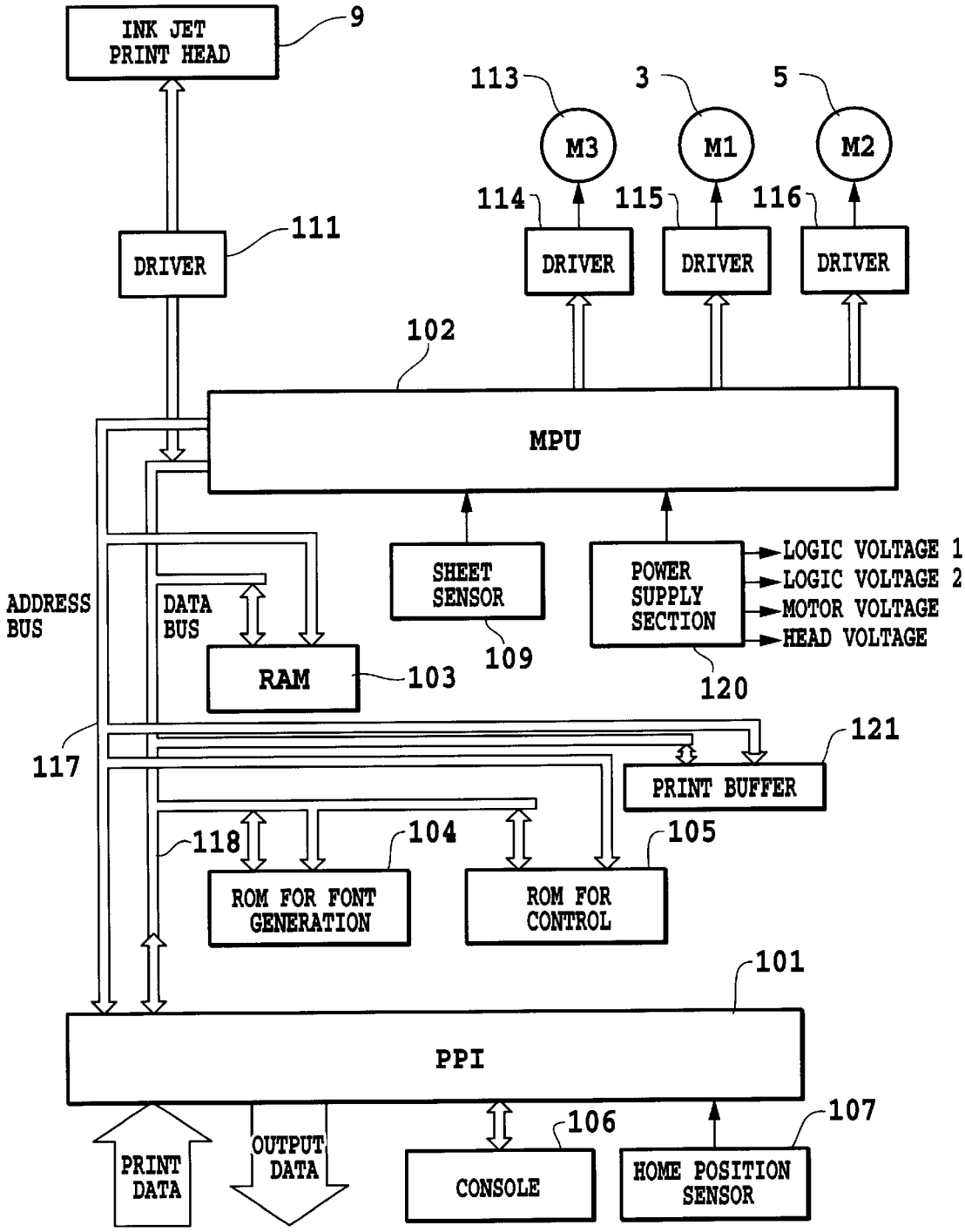
FIG. 3 is a block diagram of a control system in the printing apparatus in FIG. 1.
Figure 4:
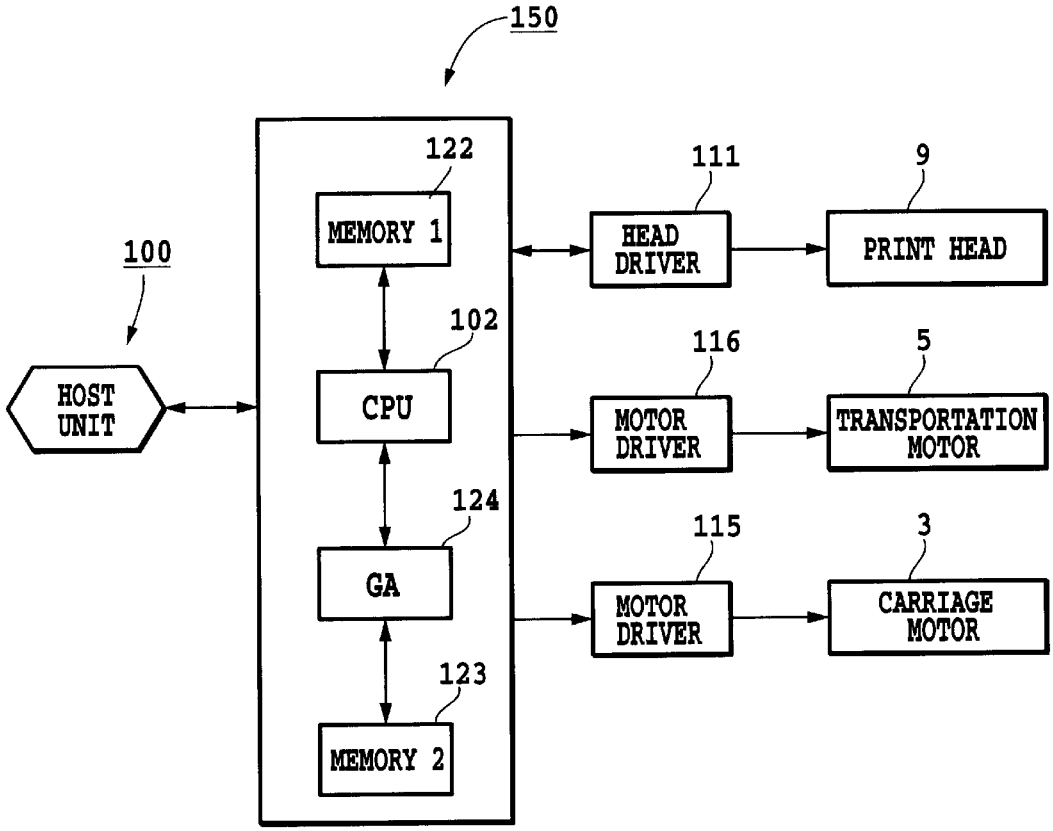
FIG. 4 is a block diagram of the control system in the printing apparatus in FIG. 1.

FIG. 3 is an explanatory drawing of the flow of data in the printing apparatus of the present embodiment. FIG. 4 is a block diagram of a control system in the printing apparatus of the present embodiment.

In FIG. 3, reference numeral 101 denotes a programmable peripheral interface (hereinafter referred to as a "PPI") that receives command signals and print information signals sent from a host computer (host device, not shown) and transfers these signals to an MPU 102. Further, the PPI 101 receives control signals for a console 106 and input signals from a home position sensor 107 detecting that the carriage 2 is at the home position. The MPU (Micro Processing Unit) 102 controls the components of the printing apparatus in accordance with a control program stored in a ROM 105 for control. Reference numeral 103 denotes a RAM that temporarily stores various data. The RAM 103 stores received signals or is used as work area for the MPU 102. Reference numeral 104 denotes a ROM for font generation which stores pattern information such as characters and records corresponding to code information and which outputs various pattern information corresponding to input code information. Reference numeral 121 denotes a print buffer memory that stores data expanded by the ROM 104 or the like. The print buffer memory 121 has a capacity sufficient to store m lines of print data. Reference 105 denotes a control ROM that stores a process procedure executed by the MPU 102. Each of these components is controlled by the MPU 102 via an address bus 117 and a data bus 118.

Reference numeral 3 is a carriage motor that reciprocates the carriage 2 in the main scanning direction, the carriage 2 having the print head 9 mounted thereon. Reference numeral 5 denotes a sheet feeding motor that transports a printed medium such as paper in the sub-scanning direction orthogonal to the direction in which the carriage 2 moves. Reference numeral 113 is a capping motor that drives a cap material so as to cap the print head 9, thereby shutting off ink nozzles (not illustrated) in the print head 9 from the outside air to prevent the nozzles from drying up. The capping motor also operates a wiper to perform operations such as wipe-off of ink from a surface (head face) of the print head 9 in which the ink nozzles are formed. Reference numeral 115 denotes a motor driver for driving the carriage motor 3, 116 is a motor driver for driving the sheet feeding motor 5, and 114 is a motor driver for driving the capping motor 113. Further, keyboard switches and display lamps are installed on the console 106. Moreover, the home position sensor 107 is installed near the home position of the carriage 2 to detect that the carriage 2 mounted on the print head 9 has reached the home position. Reference numeral 109 denotes a sheet sensor that detects the presence of a printed medium such as a print sheet, that is, whether or not the printed medium has been provided to a predetermined printing section. At the home position, a recovery process can be executed to allow the print head 9 to keep on ejecting ink appropriately. Such a recovery process includes the wiping operation performed by the wiper as well as a process of ejecting ink that does not contribute to printing images, from the print head 9 to the interior of the cap member (preliminary ejection) and a process of using suction force or pressing force to eject ink that does not contribute to printing images, from the print head 9.

The print head 9 in the present embodiment is of an ink jet type that ejects ink droplets by using thermal energy to cause film boiling in ink to thereby change the condition of the ink. The print head 9 has m (for instance, 64) nozzles and m ejection heaters (electrothermal converting elements) corresponding to the nozzles all installed therein. Reference numeral 111 denotes a driver for driving the ejection heaters in the print head 9 in accordance with print information signals. Reference numeral 120 denotes a power supply section that supplies power to each of the above components. The power supply section has an AC adapter and a battery as a driving power supply device.

In this construction, the MPU 102 is connected to the host device such as a computer via the PPI 101 to control printing operations on the basis of command and print information signals sent from this host device, a program process procedure stored in the ROM 105 for control, and print information stored in the RAM 103.

Further, in the printing apparatus of the present embodiment, a host device 100 transmits print data via a parallel port, a serial port, a network, or the like, as in the case with general printing apparatuses of this kind. In this case, the host device transmits commands containing normal data, the leading part of which contains the type of print media on which images are to be printed (media such as ordinary paper, OHP, or gloss paper, or special media such as transfer films, cardboards, or banner paper), the size of the print media (A4, A4 letter, A3, B4, B5, or an envelope or post card size), printing quality (draft, high quality, intermediate quality, emphasis on particular colors, monochrome/color, or the like), a sheet feeding source (ASF, manual feeding, bin 1, bin 2, or the like), enabling or disabling of automatic determination of an object, and other data. By receiving such a command, the printing apparatus main body performs a printing operation on the basis of various data stored in a memory region (memory 1 112) of the ROM. Further, information as to whether or not a process liquid is to be applied to improve printability may be transmitted as commands. In accordance with this information, the printing apparatus loads required data from the ROM to perform a printing operation according to this data. Data read out from the ROM includes the number of passes used for multipass printing, the type of a mask used for each pass, driving conditions for the print head (for instance, the shape of pulses to be applied and application time), the size of ink droplets, sheet feeding conditions, and carriage speed. In FIG. 4, reference numeral 124 denotes a gate array GA, and reference numeral 123 denotes a memory 2.

The ink tank 201 (see FIG. 2) is formed of a polypropylene (PP) or polyethylene (PE) resin by molding technology such as injection molding, blow molding, or welding. For example, the tank 201 may allow its sheath to be directly used as an ink chamber, contain an ink filled bag, or hold ink in a porous substance installed therein and generate negative pressure therein. Further, if the tank 201 comprises a negative pressure generating mechanism, then for instance, it may generate negative pressure by installing a spring mechanism or the like inside or outside an ink-filled bag therein to urge and bias the bag in the direction in which the bag is expanded. The present embodiment is equipped with a supply system using the tube 207 as illustrated in FIG. 2, and negative pressure is generated due to a difference in water head between the print head 9 and the tank 201. Furthermore, the ink tank 201 in the present embodiment is constructed by welding a part corresponding to the bottom surface thereof, to a sheath made of polypropylene. The ink accommodating sections 201Y, 201M, 201C, and 201B of the ink tank 201 each have two joint portions installed on the bottom surface thereof and formed of rubber 201*a* shown in FIG. 5. Pins 204 and 205 installed on the apparatus main body are inserted into these joint portions. The pin 205 is a supply pin that provides ink contained in the tank 201 to the print head 9, and pin 204 is an atmosphere communication tube that allows the outside air pressure to be introduced into the tank due to an increase in negative pressure resulting from the supply of ink. Inside the joint portion into which the atmosphere communication pin 204 is inserted, an annular wall portion 201*b* of a predetermined height is formed so as to surround this joint portion.

Figure 6:
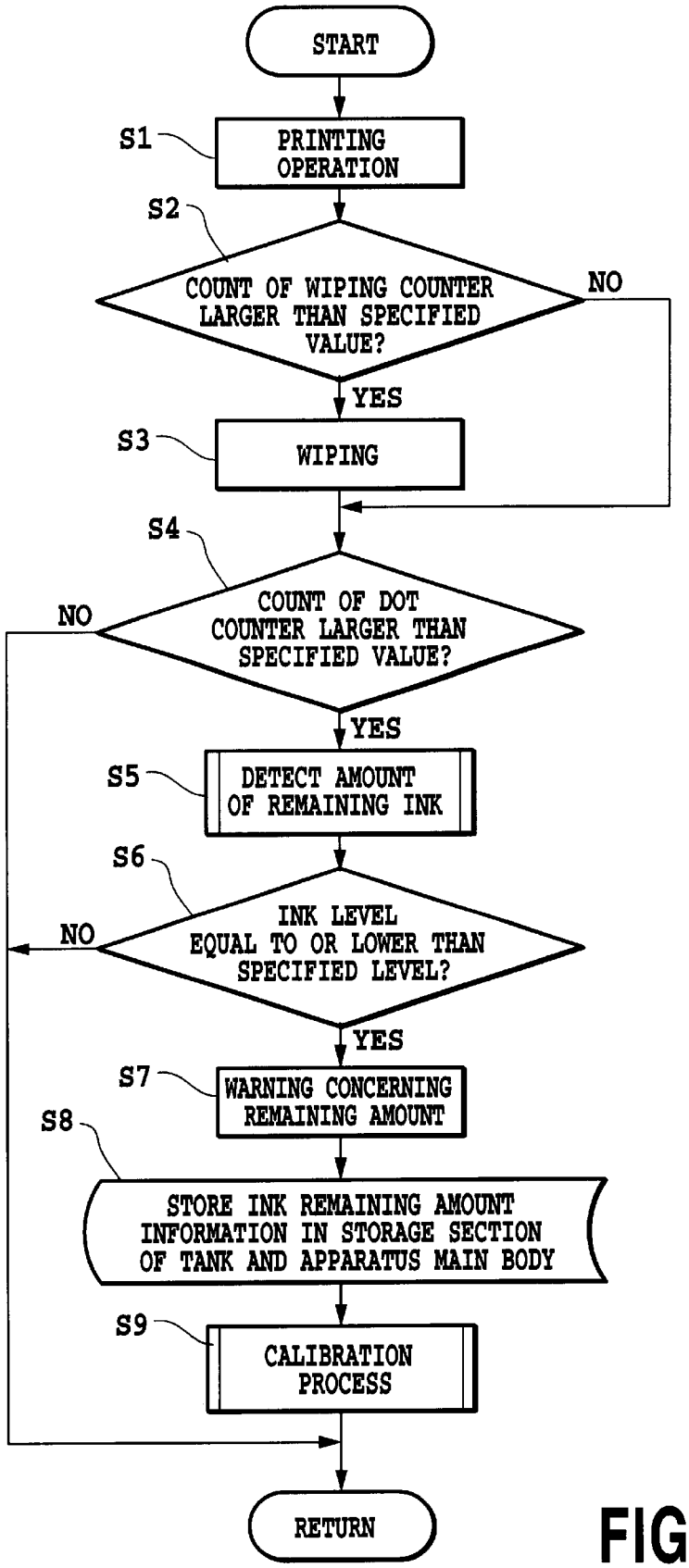
FIG. 6 is a flow chart for describing a process of detecting the amount of remaining ink according to an embodiment of the present invention.

FIG. 6 is a flow chart useful in describing a process executed after completing a printing operation.

First, after a printing operation has been completed (step S1), a wiping counter is checked (step 2) to judge whether or not to perform a wiping operation. In general, whether or not to wipe the nozzle formed surface of the print head 9 is judged on the basis of the number of ink droplets ejected from the print head 9 (this is equivalent to the number of printed dots), printing time, printing duty, or the like. In this case, a wiping operation is performed when the count of the wiping counter, which counts the number of ejected ink droplets, reaches a predetermined value (steps S2 and S3). The number of ejected ink droplets can be determined on the basis of image data. Furthermore, the wiping counter is reset each time a wiping operation is completed. After completion of the wiping operation, in order to detect the amount of remaining ink, it is determined whether or not the count of the dot counter exceeds a specified value (step S4). A dot counter counts the number of ink droplets ejected from the print head 9 on the basis of image data and the like, and is reset when the tank 201 is replaced with a new one. Further, this dot counter constitutes both a means for determining the count and a means for detecting the amount of remaining ink. This detecting means can be constructed as software composed of a program, and will thus hereinafter also be referred to as "software-based detection means". Further, since the dot count method executes mathematical estimation on the basis of the count as described previously, the dot counter will also be referred to as "remaining amount estimating means".

If the count of the dot counter has not reached the specified value yet, the software-based detecting means performs the following printing operation without detecting the amount of remaining ink using hardware-based detecting means, described later. If no print data is transmitted for a next printing operation, then after a predetermined period of time, a print completing operation including wiping and capping is performed. On the other hand, if the count of the dot counter has reached the specified value, the amount of remaining ink is detected (step S5).

At step S5, the amount of remaining ink is detected by using an ink detecting means (hereinafter also referred to as the "hardware-based detecting means") equipped with mechanically constructed electrodes. To achieve this detection, all unwanted operations are stopped with only the ink remaining amount detecting operation being performed in order to avoid electrical noise. However, if no noise is likely to occur, detection of the amount of remaining ink may be executed parallel with the printing operation. In this case, it is unnecessary to set, within the period of the printing operation, a special time to wait for the amount of remaining ink to be detected.

Figure 5:
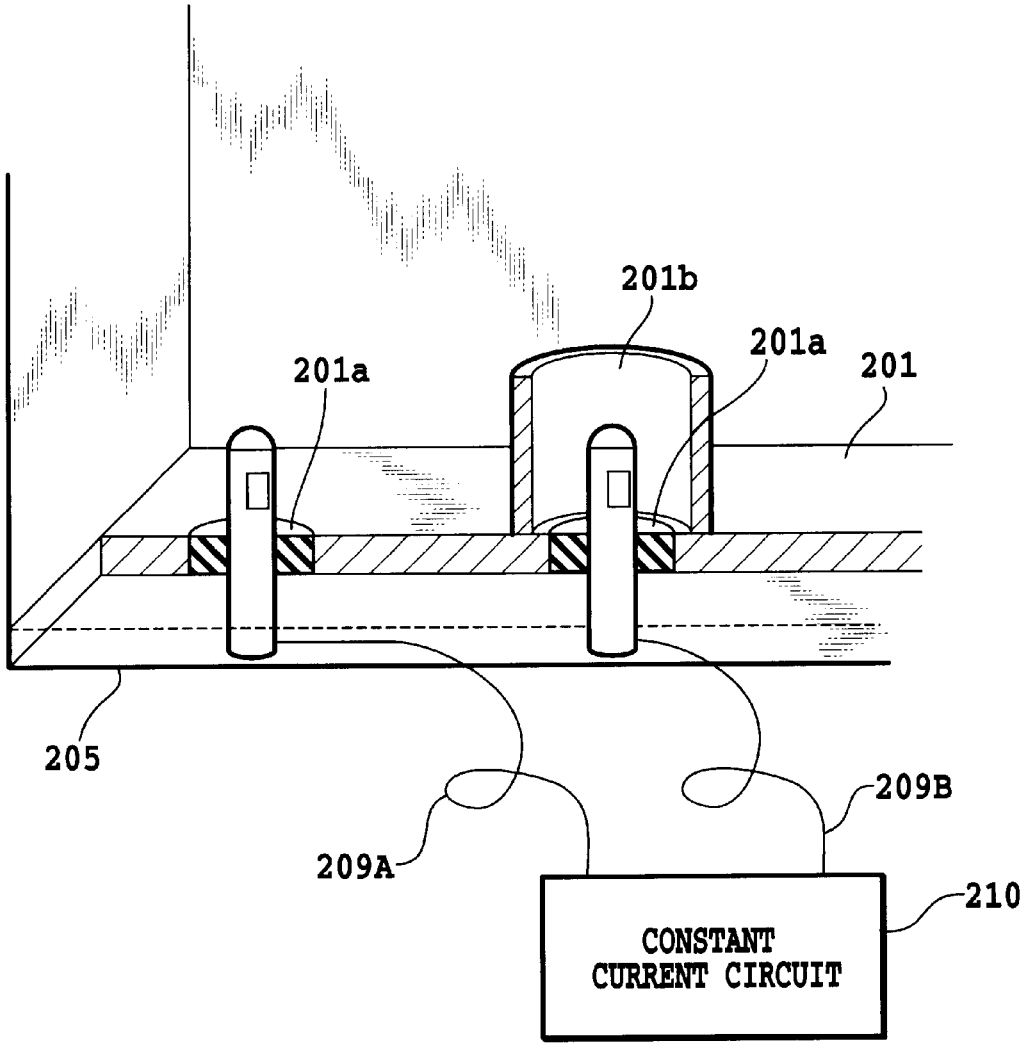
FIG. 5 is an enlarged sectional view of the vicinity of the bottom of an ink tank in the printing apparatus in FIG. 1.

The hardware-based detecting means can be constructed by, for instance, using the supply pin 205 and atmosphere communication pin 204 shown in FIG. 5, as electrodes. That is, the supply pin 205 and the atmosphere communication pin 204 are each formed of a conductive metal material, and each have one end of a conductive wire 209A or 209B, respectively, connected thereto. The conductive wires 209A and 209B have a constant current circuit 210 connected to the other end thereof. The constant current circuit 210 is constructed so that a direct current of 100 $\mu$A flows between the pins 205 and 204 with a maximum voltage of 5V. Accordingly, when no ink is present in the tank 201 or the tank 201 has not been installed, a maximum voltage of 5V is applied. Further, when the ink present in the tank 201 causes the pins 205 and 204 to be electrically connected together, the applied voltage varies depending on the resistance value of the ink. The hardware-based detecting means detects the presence of ink in the tank 201 on the basis of such a variation in applied voltage.

Figure 8:
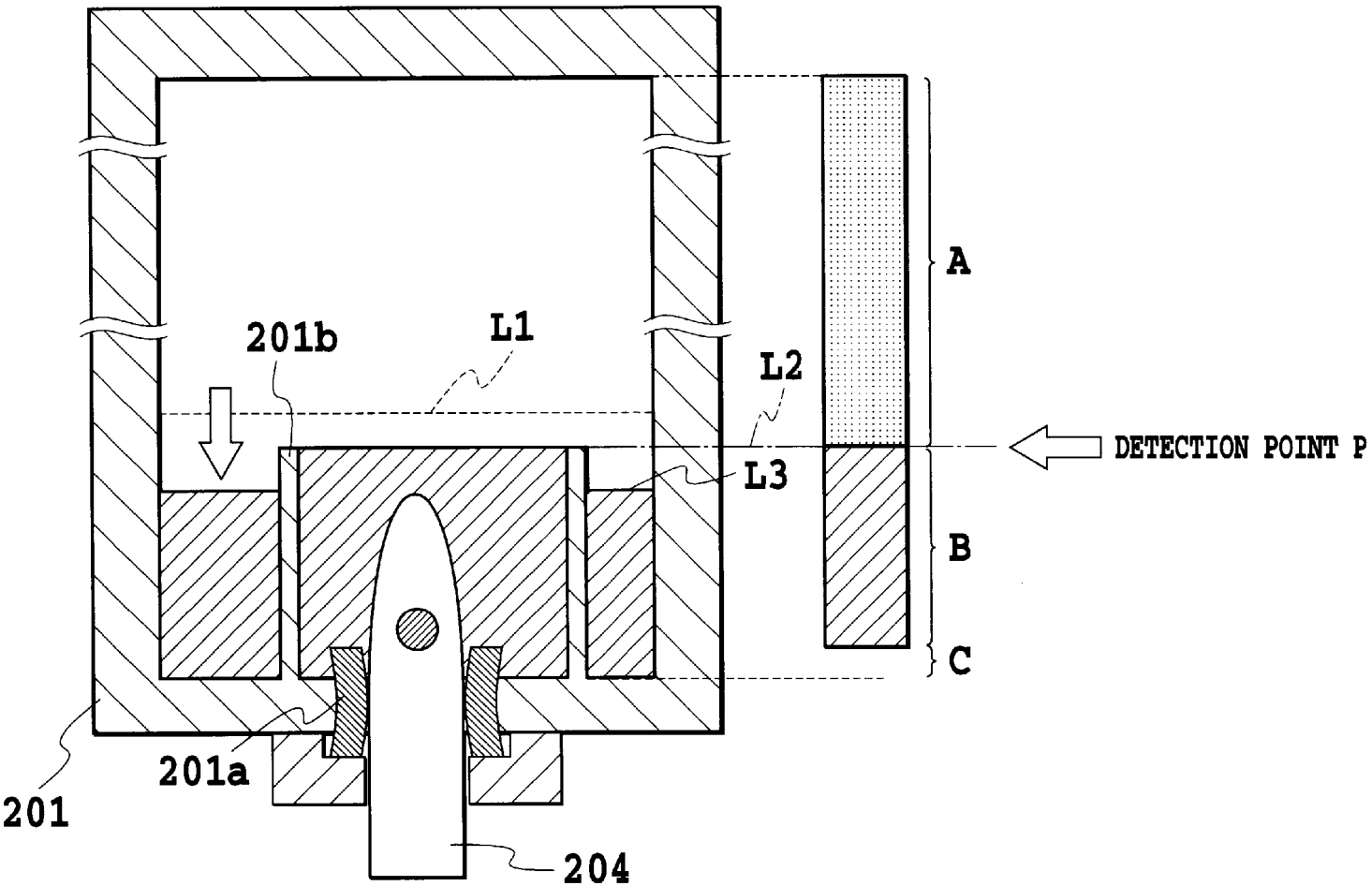
FIG. 8 is a sectional view for explaining the principle of detection of the amount of ink remaining in the ink tank in FIG. 5.

FIG. 8 is a view useful in explaining the principle of detection. As shown by levels L1, L2, and L3 in the figure, the level of the ink in the tank 201 lowers gradually depending on the consumption of the ink. If the ink level is higher than the upper end of the annular wall portion 201*b*, surrounding the atmosphere communication pin 204, as shown by the level L1, then the atmosphere communication pin 204 and supply pin 205, functioning as electrodes, are connected together via the ink in the tank 201, which is also present beyond the annular wall portion. On the other hand, if the ink level lowers below the upper end of the annular wall portion 201*b* as shown by the level L3, then the annular wall portion 201*b* shuts off the ink present inside from the ink present outside, thereby preventing the pins 204 and 205 from being connected together by the ink. Consequently, as shown by the level L2, when the ink level reaches the upper end of the annular wall portion 201*b*, that is, a boundary (detection point P), the applied voltage between pins 204 and 205 changes. The hardware-based detecting means detects the point of time at which the ink has reached the level L2 on the basis of this change in applied voltage.

Referring back to FIG. 6, at step S5, the hardware-based detecting means detects the amount of remaining ink to determine whether or not the amount of remaining ink is equal to or smaller than the specified level, that is, whether or not the ink level is equal to or lower than the level L2. If the amount of remaining ink is equal to or smaller than the specified level, a warning will be given (step S7), and information on amount of remaining ink is stored in the storage section installed in each of the tank 201 and the apparatus main body.

Figure 7:
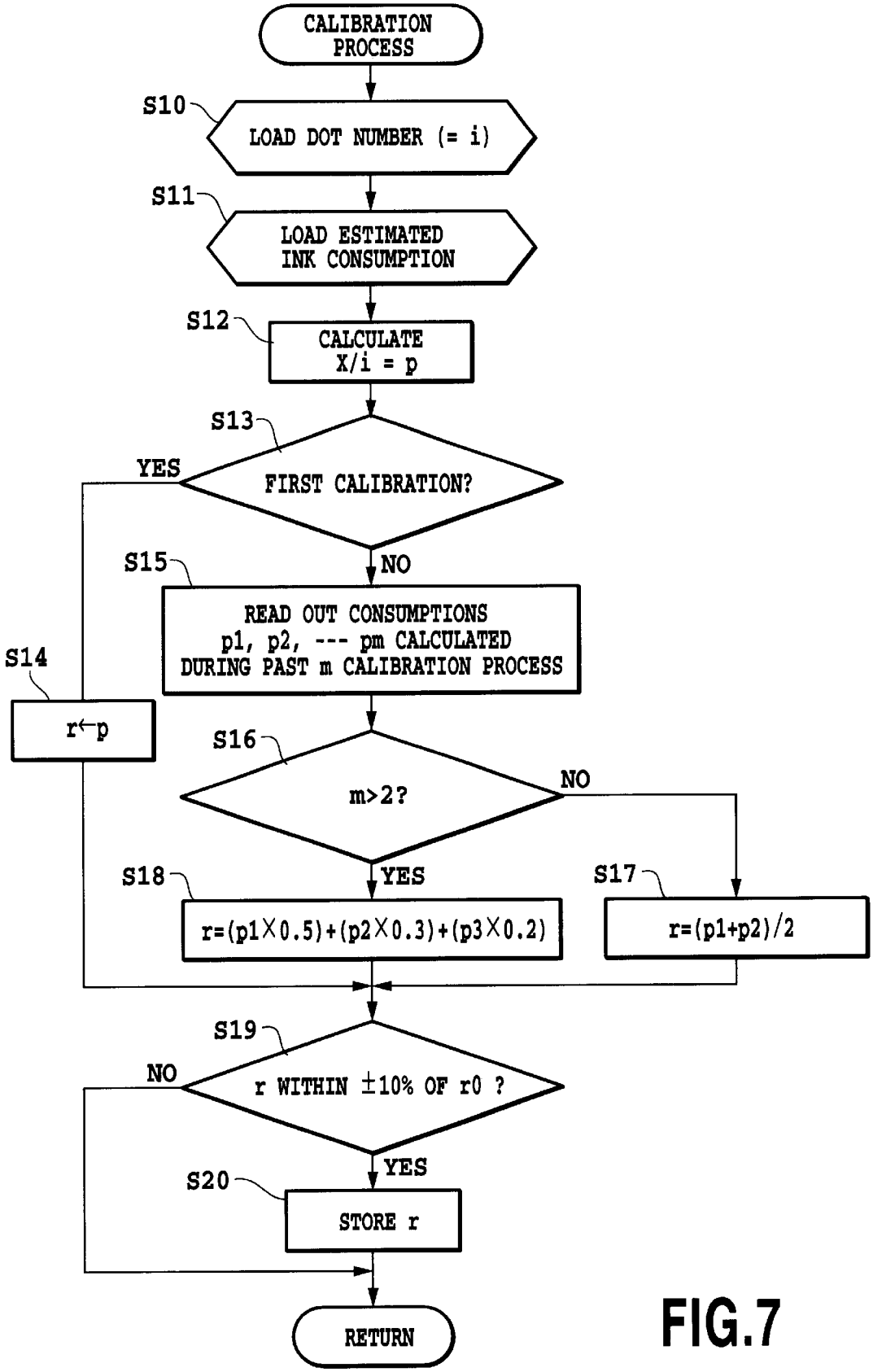
FIG. 7 is a flow chart for describing a calibration process, shown in FIG. 6.

At the next step S9, the calibration process shown in FIG. 7 is executed.

First, the count of the dot counter (hereinafter referred to as a "dot number i") of the software-based detecting means is loaded (step S10). Then, estimated ink consumption X, that is, the estimated amount of consumed ink at the time of the execution of detection by the hardware-based detecting means, is loaded. The estimated consumption X is stored in, for instance, a storage means installed in the tank 201, and corresponds to the amount of ink consumed before the level of the ink, of which the ink tank 201 was full, reaches the detection point P in FIG. 8. Next, consumption p per dot (p=X/i) is determined (step S12) and stored in the storage means of the tank 201, print head 9, apparatus main body, or host device. If the calibration process in FIG. 7 is to be executed for the first time, then under the assumption that the consumption p is within a predetermined allowable range, the consumption p is defined as a unit consumption r (step S14). On the other hand, if the calibration process is to be executed for the second or later time, the consumption value p determined by the last calibration process is defined as p1, and the consumption values p determined by the previous calibration processes are defined as p2, p3, . . . in the order of elapsed time. These values are then stored. During the second or later calibration process, the consumption values p determined during the previous m calibration processes, that is, the values p1, p2, . . . , pm are read out (step S15). The values p1, p2, . . . , pm determined during the previous calibration processes are then weighted to determine a unit consumption r.

In the present embodiment, if the number of previous calibration processes is m (m≦2), then at step S17, the consumption values p1 and p2 are equivalently weighted to determine a unit consumption r using the following equation:

$$r=(p1+p2)/2 \tag{1}$$

On the other hand, if the number of previous calibration processes is m (m>2), the consumption values p1, p2, and p3 are subjected to different weights to determine a unit consumption r using Equation (2). Furthermore, in Equation (2), the number of previous calibration processes is 3, but the present invention is not limited to this number. That is, in Equation (2), the unit consumption r is determined by weighting each of the three previous consumption values pm, but more than three values may be used. Moreover, in Equation (2), the weight increases with the passage of time. That is, under the assumption that the amount of ejected ink gradually varies partly because of a temporal changes in the print head, larger weights are set for values obtained more recently. Further, the level of weighting is not limited to Equation (2).

$$r=(p1\times 0.5)+(p2\times 0.3)+(p3\times 0.2) \tag{2}$$

Next, after the unit consumption r has been obtained as described above, it is determined whether or not this value is within ±10% of an initial value r0. The initial value r0 is specific to the print head 9, and is stored in, for instance, the storage means of the tank 201, print head 9, apparatus main body, or host device. In the present embodiment, the initial value r0 is compared with the current unit consumption r. Under the assumption that a tolerable error in calculated consumption r is within ±10% of the initial value r0, if the consumption deviates from this range, the current unit consumption r is excluded, and the last unit consumption r is made effective. This avoids the adverse effects of the following situation: the print head 9 may inappropriately eject the ink, that is, bubbles or contaminants in the print head 9 may cause the ink to be inappropriately ejected, thereby preventing the consumption of an amount of ink corresponding to the calculated number of ink dots.

If the current unit consumption r is within ±10% of the initial value r0, it is set as the latest value for update (step S20). This unit consumption r is stored in, for instance, the storage means of the tank 201, print head 9, apparatus main body, or host device.

The latest unit consumption r is used to calculate the amount of ink remaining in the tank 201. If the amount of ink remaining in the tank 201 is within the range A in FIG. 8, it can be calculated using the initial value r0 of the unit consumption or the latest unit consumption r. For instance, the amount of remaining ink within the range A can be calculated by multiplying the initial value r0 of the unit consumption or the latest unit consumption r by the count of the dot counter and then subtracting the obtained value from the amount of ink measured when the tank 201 is full of the ink. Then, at the detection point P, the hardware-based detecting means detects that the ink has reached the level L2, as described previously. At this detection point, by giving a warning as described previously (step S7 in FIG. 6), the user can be urged to prepare a new replacement tank. In the present embodiment, after this detection point, a cleaning operation that consumes a large amount of ink is limited. In the range B shown in FIG. 8 and which is located below the detection point P, the amount of remaining ink is continuously calculated by using the latest unit consumption r, which has been newly determined by a calibration process. On the basis of the calculated value of the amount of remaining ink, it is detected that the amount of remaining ink has reached a range C. At this point of time, the printing operation is stopped to inhibit driving pulses from being applied to the print head 9. Thus, in the present embodiment, a warning is given when the amount of remaining ink becomes smaller than the specified value to cause the level of the liquid to reach the detection point P, but at this point of time, several grams of ink still remains; the ink has not been exhausted yet. Then, after the amount of remaining ink has decreased below the range A, the number of dots is further counted to calculate the amount of remaining ink using this count and the latest unit consumption r, thereby enabling the printing operation to be continued until the amount of remaining ink reaches the range C shown in FIG. 8.

Figure 9:
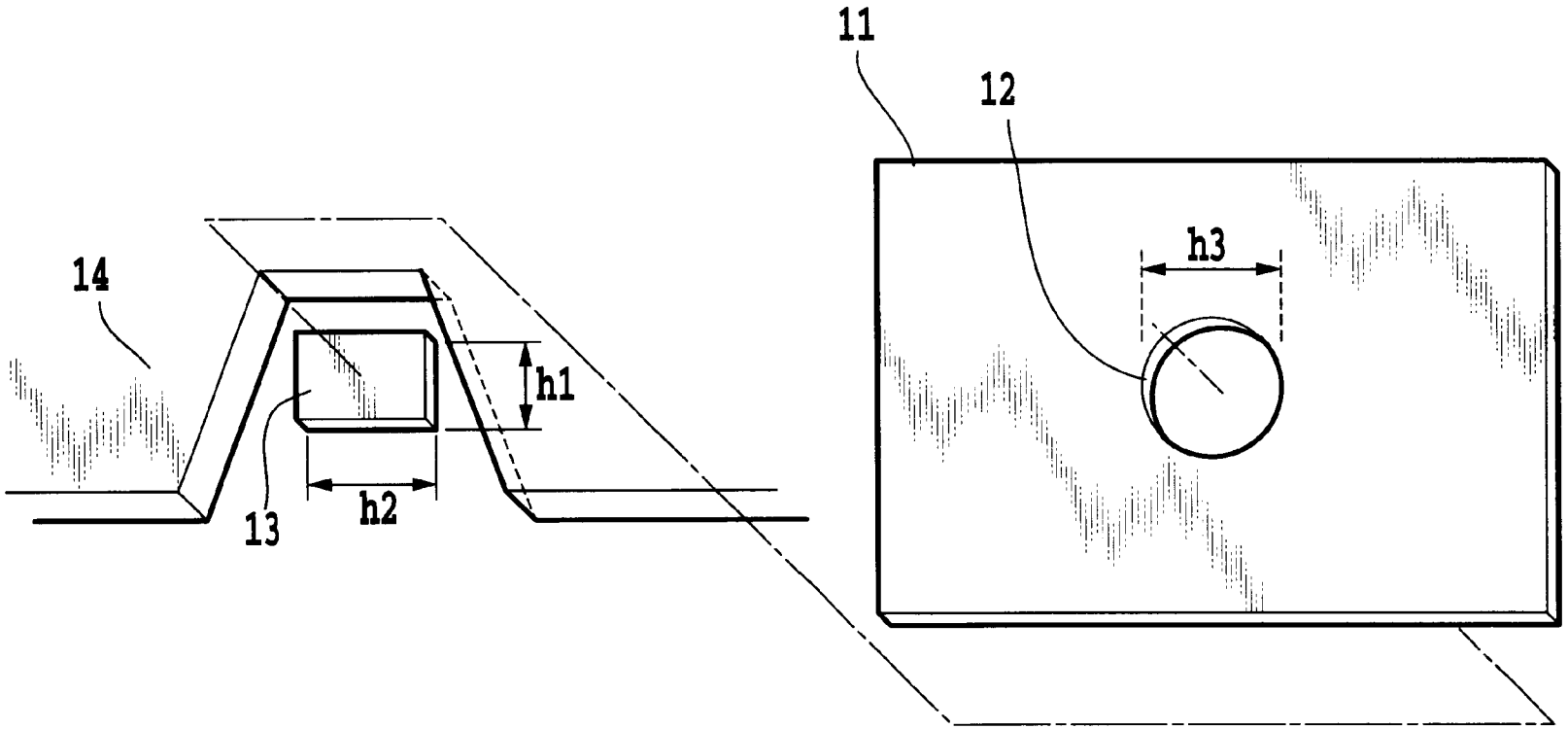
FIG. 9 is a perspective view of essential parts of a print head, the view being useful in schematically describing the construction of a nozzle portion of a print head.

By measuring the actual amount of ejected ink during a process of manufacturing or inspecting the print head 9 before shipment, the initial value r0 of the unit consumption can be written to the storage means of the print head 9. If it is difficult to measure the actual amount of ejected ink, this value can be determined on the basis of data on the components of the print head 9. FIG. 9 shows an example of the construction of essential parts of the print head 9. The print head 9 has heaters 13 and a liquid chamber forming section 14 all installed on a substrate thereof. Heat from each heater 13 causes the ink on the heater 13 to bubble so that the resulting bubbling energy causes ink droplets to be ejected through ink nozzles 12 in an orifice plate 11. If the print head 9 is constructed as shown in FIG. 9, the length h1 and width h2 of the heater 13, the inner diameter h3 of each nozzle 12, and the size of a chamber for ejected ink can be measured to convert the amount of ejected ink on the basis of these data. Then, the initial value r0 can be determined using one or more such converted values of the amount of ejected ink. Further, in the present embodiment, the unit consumption r can be more accurately calculated by accumulating a plurality of data on the unit consumption r in the storage means installed in the tank 201 or apparatus main body. Accordingly, if the tank 201, which supplies ink to the print head 9, is replaced with a new one, the amount of remaining ink can be more accurately detected by increasing the accuracy with which the unit consumption r is calculated, consistently with the number of times the ink tank has been replaced.

Figure 10:
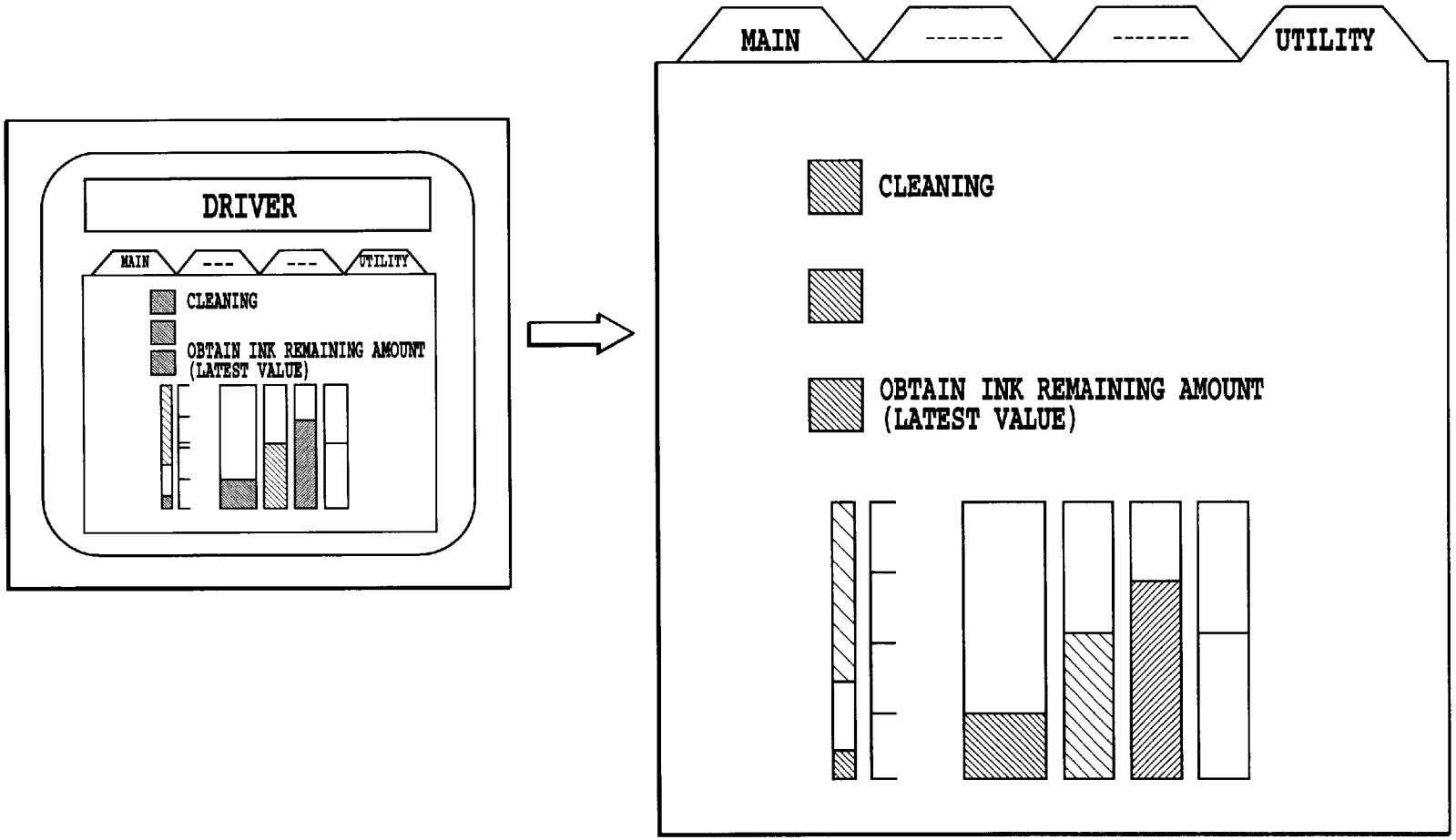
FIG. 10 is an explanatory drawing of an example of a method of displaying a warning concerning the amount of remaining ink.
Figure 11:
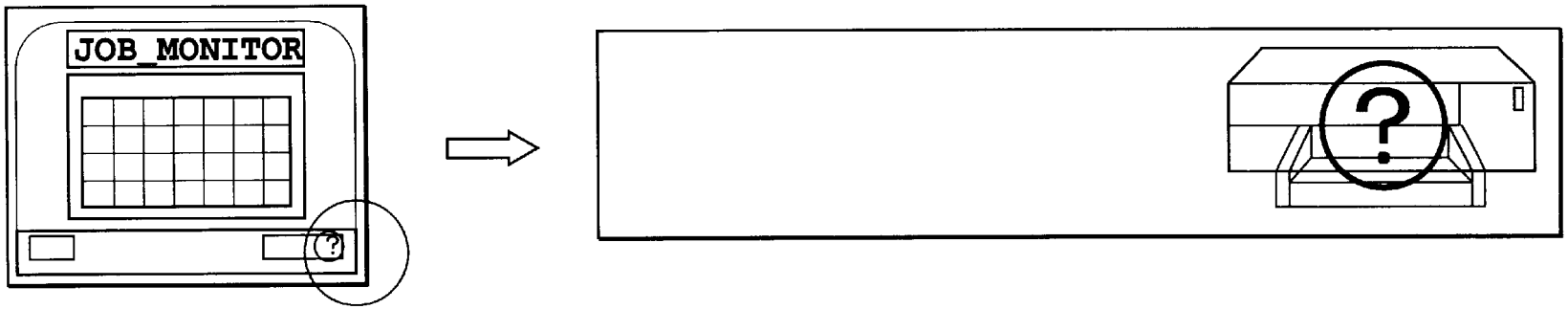
FIG. 11 is an explanatory drawing of another example of displaying a warning concerning the amount of remaining ink.
Figure 12:
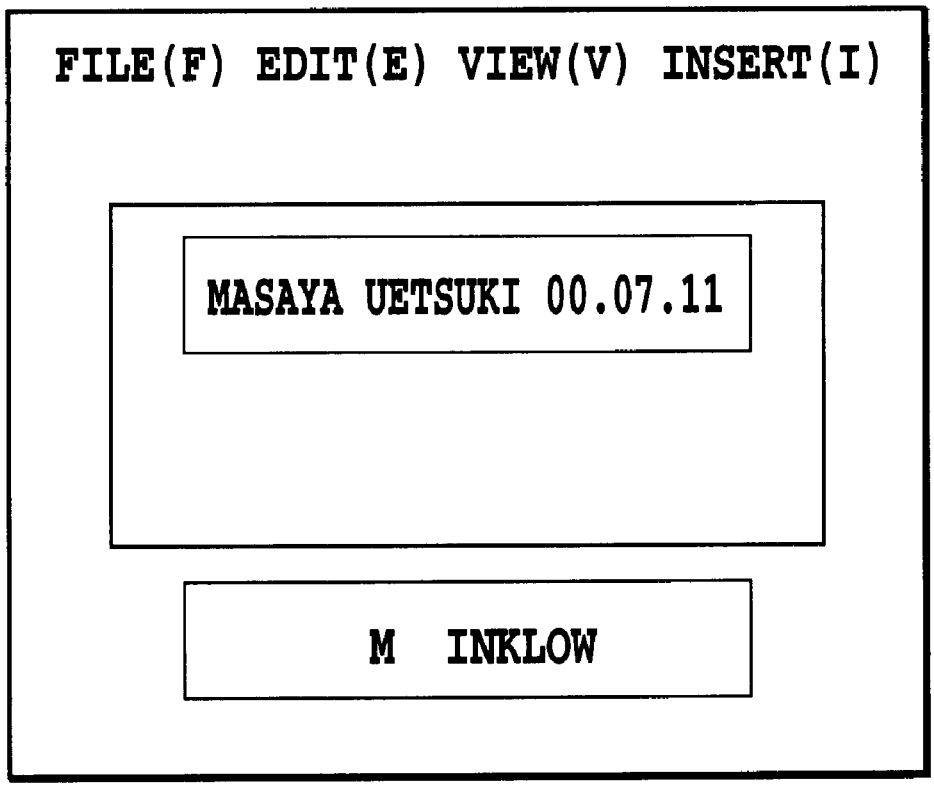
FIG. 12 is an explanatory drawing of yet another example of displaying a warning concerning the amount of remaining ink.

The amount of remaining ink can be displayed using a means for displaying the amount of remaining ink, which means is installed in the printing apparatus main body. However, some recent printing apparatuses have no display section in order to reduce costs. For such a construction, a driver installed in the host device can be used to show the amount of remaining ink on the display section of the host device, as shown in FIG. 10. Further, with a status monitor mounted in the apparatus, a warning can be displayed on a task tray as shown in FIG. 11, or can be displayed as a pop-up window on the display section of the host device as shown in FIG. 12.

Moreover, the unit consumption r can be stored in the storage means of the print head 9 or host device instead of the storage means of the tank 201 or unit main body. It is also possible to control the amount of ink ejected from the print head 9 on the basis of the unit consumption r. Controlling the amount of ejected ink prevents bleeding or the like caused by individual differences between print colors in color expressions for each print head 9 or an excessive amount of ejected ink. Furthermore, in determining the amount of waste ink resulting from a recovery process for the print head 9 such as the preliminary ejection described above, the unit consumption r can be used to more accurately estimate the amount of waste ink.

Figure 13:
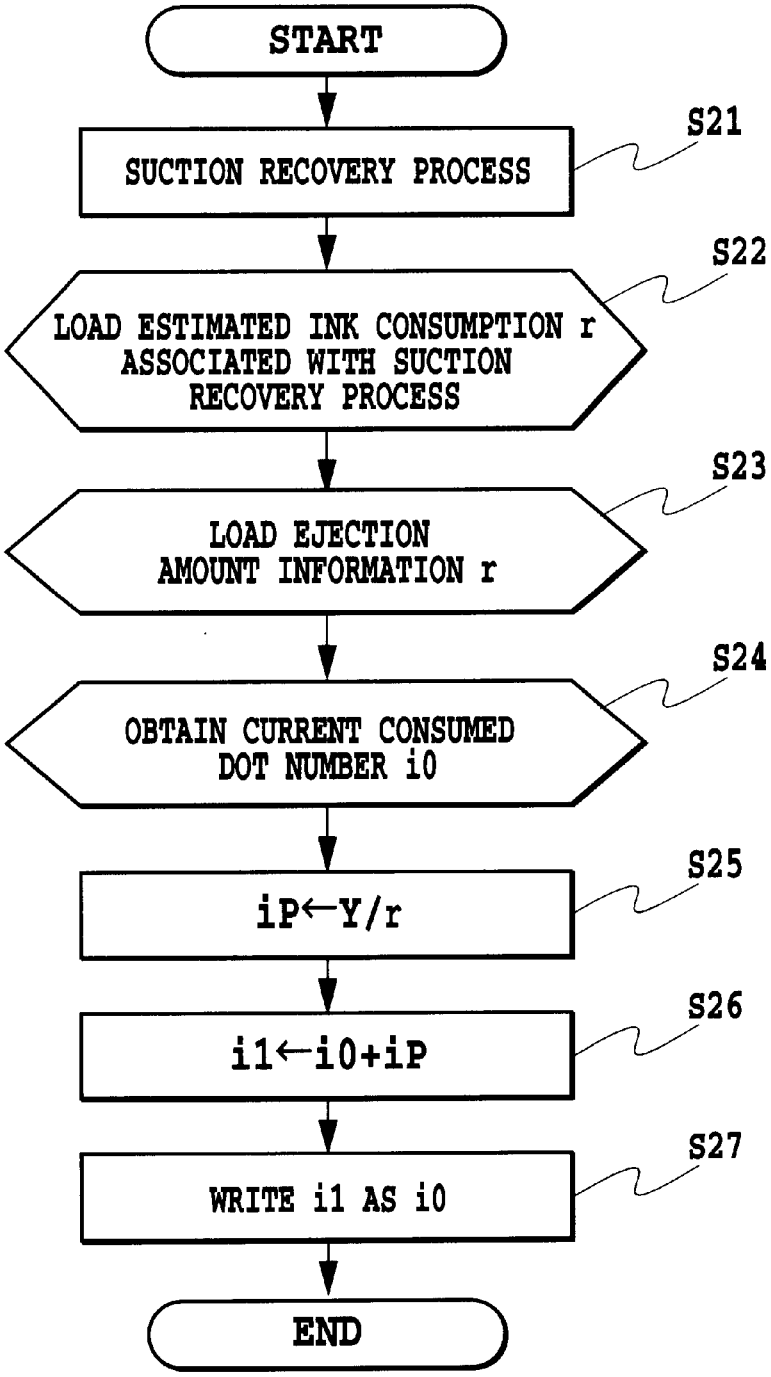
FIG. 13 is a flow chart for describing a correcting process executed during a recovery process according to an embodiment of the present invention.

FIG. 13 is an explanatory drawing of a process procedure used to more accurately determine the amount of remaining ink by considering the ink consumption associated with a recovery process for the print head 9. In the present embodiment, the recovery process for the print head 9 comprises a process of sucking and discharging ink not contributing to printing images, through the nozzles in the print head 9.

First, a suction recovery process is executed (step S21), and the assumed amount Y of each type of ink consumed in connection with this process is read out (step S22). This assumed ink consumption Y is stored in the storage means of the tank 201, print head 9, apparatus main body, or host device. Next, the unit consumption r is loaded as information on the amount of ejected ink (step S23), and the current count of the dot counter is obtained and set as the current consumed dot number i0 (step S24) Subsequently, the ink consumption associated with the recovery process is converted into a dot number ip on the basis of Y/r (step S25). Then, the dot numbers i0 and ip are added together to obtain a dot number i1 (step S26). This dot number i1 is written to the storage means as the current consumed dot number i0. By using the consumed dot number i0 as a count in the dot counter, the ink consumption associated with the recovery process can be reflected to more accurately detect the amount of remaining ink. Further, the hardware-based detecting means is not limited to the above described method, but an optical sensor may be used to detect the liquid level in the ink tank. Moreover, as a detecting method based on an optical sensor, it is also possible to, for instance, install a prism in a part of the ink tank, irradiate the prism with light, and detect a change in the quantity of reflected light on the basis of the presence of ink contacting with the prism.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus that prints an image on a print medium by using a print head that can eject ink fed from an ink tank, the apparatus comprising:

estimating means for estimating ink consumption by making a calculation on the basis of driving conditions for the print head;

detecting means for detecting that an ink level of ink remaining in said ink tank has decreased to a predetermined value; and correcting means for correcting a value used in the calculation for estimating the ink consumption by said estimating means, on the basis of the ink consumption estimated by said estimating means when said detecting means detects that the ink level has decreased to the predetermined value.

2. The ink jet printing apparatus according to claim 1, wherein said estimating means estimates the ink consumption on the basis of the number of ink droplets ejected from said print head.

3. The ink jet printing apparatus according to claim 2, wherein said estimating means determines the number of ink droplets ejected from said print head on the basis of image data to be printed on the print medium.

4. The ink jet printing apparatus according to claim 1, wherein said detecting means comprises a pair of electrodes that are electrically connected together by the ink in said ink tank when the ink level is above the predetermined value, the electrodes not being electrically connected together by the ink in said ink tank when the ink level has decreased to the predetermined value.

5. The ink jet printing apparatus according to claim 1, further comprising means for calculating the amount of ink remaining in said ink tank on the basis of the ink consumption estimated by said estimating means using the value corrected by said correcting means.

6. The ink jet printing apparatus according to claim 1, wherein at least either said ink tank or the main body of said ink jet printing apparatus comprises storage means for storing the value corrected by said correcting means.

7. The ink jet printing apparatus according to claim 1, further comprising a carriage that moves relatively to the print medium and that allows said print head to be mounted thereon, wherein said ink tank includes a subtank mounted on said carriage and a main tank installed in the main body of said ink jet printing apparatus, and wherein said detecting means detects the level of ink remaining in said main tank.

8. The ink jet printing apparatus according to claim 1, further comprising storage means for storing the value corrected by said correcting means together with information on said print head.

9. The ink jet printing apparatus according to claim 1, wherein said print head comprises storage means for storing the value corrected by said correcting means, wherein the ink consumption is estimated by using one or more past values that are at least temporarily stored in said storage means.

10. The ink jet printing apparatus according to claim 1, further comprising means for controlling the amount of ink ejected from said print head on the basis of the value corrected by said correcting means.

11. The ink jet printing apparatus according to claim 1, further comprising means for calculating the amount of waste ink discharged from said print head on the basis of the value corrected by said correcting means.

12. The ink jet printing apparatus according to claim 1, wherein the value corrected by said correcting means is the amount of ink ejected per unit number of ejected ink droplets.

13. The ink jet printing apparatus according to claim 1, wherein said print head comprises electrothermal converters that generate thermal energy utilized to eject ink.

14. An ink information detecting apparatus that detects information on ink fed from an ink tank to a print head that can eject ink, the apparatus comprising:

estimating means for estimating ink consumption by making a calculation on the basis of driving conditions for the print head;

detecting means for detecting that an ink level of ink remaining in said ink tank has decreased to a predetermined value; and correcting means for correcting a value used in the calculation for estimating the ink consumption by said estimating means, on the basis of the ink consumption estimated by said estimating means when said detecting means detects that the ink level has decreased to the predetermined value.

15. An ink information detecting method of detecting information on ink fed from an ink tank to a print head that can eject ink, the method comprising the steps of:

estimating ink consumption by making a calculation on the basis of driving conditions for the print head; and correcting a value used in the calculation for estimating the ink consumption, on the basis of the ink consumption estimated by said estimating step when detecting means detects that an ink level of ink remaining in the ink tank has decreased to a predetermined value.

16. An ink jet printing apparatus that prints an image on a print medium by using a print head that can eject ink fed from an ink tank, the apparatus comprising:

count means for counting the number of operations that consume ink, the operations including printing operations;

detecting means for detecting that an ink level of ink remaining in said ink tank has decreased to a predetermined value;

remaining amount calculating means for calculating the amount of ink remaining in said ink tank on the basis of the number counted by said count means as well as a unit consumption corresponding to the operations after said detecting means has detected that the ink level of ink remaining in said ink tank has decreased to the predetermined value; and correcting means for correcting the unit consumption on the basis of the number indicated by said count means when said detecting means has detected that the ink level of ink remaining in said ink tank has decreased to the predetermined value, wherein said calculating means calculates the amount of remaining ink on the basis of the unit consumption corrected by said correcting means.

17. The ink jet printing apparatus according to claim 16, further comprising second calculating means for calculating the amount of ink remaining in said ink tank on the basis of the number counted by said count means as well as the unit consumption until said detecting means detects that the ink level of ink remaining in said ink tank has decreased to the predetermined value, wherein the unit consumption is a unit consumption that has not been corrected by said correcting means.

18. The ink jet printing apparatus according to claim 16, further comprising suction means for discharging ink from said print head by suction, wherein said count means counts the number of times that the print head has been driven and the number of times that said suction means has been operated.

19. The ink jet printing apparatus according to claim 18, wherein said count means counts the number of times that said suction means has been operated, by replacing this number with the number of times that said print head has been driven.

20. The ink jet printing apparatus according to claim 16, further comprising storage means that can store the unit consumption corrected by said correcting means in at least either said ink tank or the main body of said printing apparatus.

21. The ink jet printing apparatus according to claim 16, further comprising a carriage that moves relatively to the print medium and that allows said print head to be mounted thereon, wherein said ink tank includes a subtank mounted on said carriage and a main tank installed in the main body of said ink jet printing apparatus, and wherein said detecting means detects the ink level of ink remaining in said main tank.

22. The ink jet printing apparatus according to claim 16, further comprising storage means for storing the unit consumption corrected by said correcting means together with information on said print head.

23. The ink jet printing apparatus according to claim 16, further comprising storage means in said print head for storing the unit consumption corrected by said correcting means, wherein the ink consumption is calculated by using one or more past values that are at least temporarily stored in said storage means.

24. The ink jet printing apparatus according to claim 16, further comprising means for controlling the amount of ink ejected from said print head on the basis of the unit consumption corrected by said correcting means.

25. The ink jet printing apparatus according to claim 16, further comprising means for calculating the amount of waste ink discharged from said ink head on the basis of the unit consumption corrected by said correcting means.

26. The ink jet printing apparatus according to claim 16, wherein the unit consumption corrected by said correcting means is the amount of ink ejected per unit number of ejected ink droplets.

27. The ink jet printing apparatus according to claim 16, wherein said detecting means comprises a pair of electrodes that are electrically connected together by the ink in said ink tank when the ink level is above the predetermined value, the electrodes not being electrically connected together by the ink in said ink tank when the ink level is below the predetermined value.

28. A method of calculating the amount of ink in an ink tank in an ink jet printing apparatus that prints an image on a print medium by using a print head that can eject ink fed from the ink tank, the method comprising the steps of:

counting the number of operations that consume ink, the operations including printing operations;

detecting that an ink level of ink remaining in the ink tank has decreased to a predetermined value;

correcting a unit consumption used to calculate the amount of remaining ink, on the basis of the number obtained at said counting step when said detecting step has detected that the ink level of ink remaining in the ink tank has decreased to the predetermined value; and after said detecting step has detected that the ink level of ink remaining in the ink tank has decreased to the predetermined value, counting the number of operations that consume ink, the operations including printing operations, and calculating the amount of ink remaining in the ink tank on the basis of the unit consumption corrected by said correcting step.

* * * * *